US010450623B2

(12) United States Patent
Kanno et al.

(10) Patent No.: US 10,450,623 B2
(45) Date of Patent: Oct. 22, 2019

(54) FERRITIC STAINLESS STEEL SHEET HAVING EXCELLENT HEAT RESISTANCE

(71) Applicant: NIPPON STEEL & SUMIKIN STAINLESS STEEL CORPORATION, Tokyo (JP)

(72) Inventors: Norihiro Kanno, Hikari (JP); Junichi Hamada, Hikari (JP); Yoshiharu Inoue, Kitakyushu (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 0 days.

(21) Appl. No.: 14/766,296

(22) PCT Filed: Mar. 6, 2014

(86) PCT No.: PCT/JP2014/055753
§ 371 (c)(1),
(2) Date: Aug. 6, 2015

(87) PCT Pub. No.: WO2014/136866
PCT Pub. Date: Sep. 12, 2014

(65) Prior Publication Data

US 2015/0376733 A1 Dec. 31, 2015

(30) Foreign Application Priority Data

Mar. 6, 2013 (JP) ..... 2013-043975

(51) Int. Cl.

| | |
|---|---|
| ***C21D 9/46*** | (2006.01) |
| ***C22C 38/00*** | (2006.01) |
| ***C22C 38/32*** | (2006.01) |
| ***C22C 38/02*** | (2006.01) |
| ***C22C 38/04*** | (2006.01) |
| ***C22C 38/20*** | (2006.01) |
| ***C22C 38/22*** | (2006.01) |
| ***C22C 38/26*** | (2006.01) |
| ***C21D 1/84*** | (2006.01) |
| ***C21D 8/02*** | (2006.01) |
| ***C22C 38/06*** | (2006.01) |
| ***C22C 38/24*** | (2006.01) |
| ***C22C 38/28*** | (2006.01) |
| ***C22C 38/30*** | (2006.01) |
| ***C22C 38/42*** | (2006.01) |
| ***C22C 38/44*** | (2006.01) |
| ***C22C 38/48*** | (2006.01) |
| ***C22C 38/54*** | (2006.01) |

(52) U.S. Cl.

CPC ..... *C21D 9/46* (2013.01); *C21D 1/84* (2013.01); *C21D 8/0205* (2013.01); *C21D 8/0236* (2013.01); *C22C 38/00* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/42* (2013.01); *C22C 38/44* (2013.01); *C22C 38/48* (2013.01); *C22C 38/54* (2013.01)

(58) Field of Classification Search

CPC ..... C22C 38/54; C22C 38/48; C22C 38/44
See application file for complete search history.

(56) References Cited

U.S. PATENT DOCUMENTS

| | | | | |
|---|---|---|---|---|
| 6,426,039 | B2 | 7/2002 | Hirasawa et al. | |
| 9,243,306 | B2 | 1/2016 | Kanno et al. | |
| 2008/0138233 | A1 | 6/2008 | Tomita et al. | |
| 2009/0000703 | A1 | 1/2009 | Hamada et al. | |
| 2009/0120536 | A1 | 5/2009 | Tomita et al. | |
| 2009/0136378 | A1* | 5/2009 | Satou et al. | 420/91 |
| 2012/0014830 | A1 | 1/2012 | Hamada et al. | |
| 2013/0004360 | A1* | 1/2013 | Kanno et al. | 420/61 |
| 2014/0023550 | A1 | 1/2014 | Hamada et al. | |
| 2015/0044085 | A1 | 2/2015 | Kanno et al. | |

FOREIGN PATENT DOCUMENTS

| | | | |
|---|---|---|---|
| CN | 101435054 | A | 5/2009 |
| CN | 1786102 | A | 6/2009 |
| CN | 102361999 | A | 2/2012 |
| EP | 0478790 | A1 | 4/1992 |
| EP | 1930461 | A1 | 6/2006 |
| JP | 3-274245 | A | 12/1991 |
| JP | 5-33104 | A | 2/1993 |

(Continued)

OTHER PUBLICATIONS

Machine translation of JP 2010156039, 2010.*

(Continued)

*Primary Examiner* — Christopher S Kessler

(74) *Attorney, Agent, or Firm* — Birch, Stewart, Kolasch & Birch, LLP

(57) ABSTRACT

This ferritic stainless steel sheet contains, in terms of % by mass, 0.02% or less of C, 0.02% or less of N, 0.10% to 0.60% of Si, 0.10% to 0.80% of Mn, 15.0% to 21.0% of Cr, more than 2.00% to 3.50% or less of Cu, 0.30% to 0.80% of Nb, 1.00% to 2.50% of Mo, and 0.0003% to 0.0030% of B, with a remainder being Fe and unavoidable impurities, wherein a maximum particle size of ε-Cu that is present in a structure is 20 nm to 200 nm.

8 Claims, 1 Drawing Sheet

(56) References Cited

FOREIGN PATENT DOCUMENTS

| | | | | |
|---|---|---|---|---|
| JP | 2696584 | B2 | | 1/1998 |
| JP | 2004-218013 | A | | 8/2004 |
| JP | 2008-144199 | A | | 6/2008 |
| JP | 2008-189974 | A | | 8/2008 |
| JP | 2009-1834 | A | | 1/2009 |
| JP | 2009-102726 | A | | 5/2009 |
| JP | 2009-120893 | A | | 6/2009 |
| JP | 2009-120894 | A | | 6/2009 |
| JP | 2009-197306 | A | | 9/2009 |
| JP | 2009-197307 | A | | 9/2009 |
| JP | 2009-215648 | A | | 9/2009 |
| JP | 2009-235555 | A | | 10/2009 |
| JP | 2010-156039 | A | | 7/2010 |
| JP | 2011-88948 | A | | 4/2011 |
| JP | 2011-190468 | A | | 9/2011 |
| JP | 2012-117084 | A | | 6/2012 |
| JP | 2012-193435 | A | | 10/2012 |
| JP | 2012-207252 | A | | 10/2012 |
| JP | 2013-213279 | A | | 10/2013 |
| KR | 10-2011-0115619 | A | | 10/2011 |
| WO | WO 2011111871 | A1 | * | 9/2011 |
| WO | WO 2012108479 | A1 | * | 8/2012 |
| WO | WO 2012/133573 | A1 | | 10/2012 |

OTHER PUBLICATIONS

Chinese Office Action and Search Report, dated Apr. 1, 2016, for counterpart Chinese Application No. 201480006916.6, with English Translation of the Search Report.

International Search Report, issued in PCT/JP2014/055753, dated Apr. 22, 2014.

Written Opinion of the International Searching Authority, issued in PCT/JP2014/055753, dated Apr. 22, 2014.

Korean Notice of Allowance, dated Dec. 6, 2016, for corresponding Korean Application No. 10-2015-7020744, with an English translation.

International Search Report for International Application No. PCT/JP2013/056531, dated May 28, 2013.

Kato et al., "Development of a Ferritic Stainless Steel with Excellent Heat Resistance," Transactions of the Society of Automotive Engineers of Japan, vol. 39, No. 2, Mar. 25, 2008, pp. 329-333, including an English Abstract.

U.S. Office Action for U.S. Appl. No. 14/384,121, dated Mar. 2, 2017 (Non-Final Rejection).

U.S. Office Action for U.S. Appl. No. 15/728,722, dated Oct. 19, 2018.

* cited by examiner

FERRITIC STAINLESS STEEL SHEET HAVING EXCELLENT HEAT RESISTANCE

TECHNICAL FIELD

The present invention relates to a ferritic stainless steel sheet having excellent heat resistance that is optimal for an exhaust system member and the like in which heat resistance, particularly, good thermal fatigue properties are required.

The present application claims priority on Japanese Patent Application No. 2013-043975 filed on Mar. 6, 2013, the content of which is incorporated herein by reference.

BACKGROUND ART

Exhaust system members, such as an exhaust manifold of an automobile and the like, are passed through by a high-temperature exhaust gas discharged from an engine, and thus a material that constitutes the exhaust system members is required to have various properties such as high-temperature strength, oxidation resistance, good thermal fatigue properties, and the like. Ferritic stainless steel having excellent heat resistance has been used for the exhaust members.

The exhaust gas temperature varies depending on the model of vehicle. In recent years, the exhaust gas temperature has been approximately in a range of 800° C. to 900° in most vehicles, and the temperature of an exhaust manifold through which the high-temperature exhaust gas discharged from the engine passes increases to be in a range of 750° C. to 850° C. which is high. However, new enforcement of restrictions on exhaust gas, and an improvement of fuel efficiency have progressed with the recent surge of environmental problems, and it is considered that the temperature of the exhaust gas may increase to be as high as approximately 1000° C.

As the ferritic stainless steel which has been used recently, SUS429 (Nb—Si added steel) and SUS444 (Nb-MO added steel) are exemplary examples, and the high-temperature strength is improved due to the addition of Si and Mo on the basis of the addition of Nb. Since SUS444 contains approximately 2% of Mo, SUS444 has the highest strength. However, SUS444 cannot be utilized at high temperatures in which the temperature of the exhaust gas is higher than 900° C., and thus there is a demand for ferritic stainless steel having a heat resistance equal to or higher than that of SUS444.

Various materials for exhaust system members have been developed to cope with the demand. For example, in Patent Document 1, in order to improve the thermal fatigue properties, a method is studied which controls the number of Cu phases having major axes of 0.5 μm or greater to be in a range of 10 pieces/25 $\mu m^2$ or less, and which controls the number of Nb compound phases having major axes of 0.5 μm or greater to be in a range of 10 pieces/25 $\mu m^2$ or less. However, only coarse precipitates of a Laves phase and an ε-Cu phase are considered, and precipitates having sizes of 0.5 μm or less are not disclosed. Patent Documents 2 and 3 disclose a method of obtaining solid-solution strengthening of Cu and precipitation strengthening due to an ε-Cu phase in addition to solid-solution strengthening of Nb and Mo by defining the amount of precipitates; and thereby, high-temperature strength equal to or higher than that of SUS444 is accomplished. However, the thermal fatigue properties are not disclosed. Patent Documents 5 and 6 disclose technologies in which W is added together with Nb, Mo, and Cu. Patent Document 5 discloses a method of utilizing solid-solution strengthening of Cu, Nb, Mo, and W, but Patent Document 5 does not disclose a thermal fatigue lifetime. Patent Document 6 discloses a method in which compounds of Fe and P are utilized as precipitation sites to allow a Laves phase and a ε-Cu to minutely precipitate into a grain; and thereby, the strength stability of precipitation strengthening and the thermal fatigue lifetime at 950° C. are improved. However, with regard to the thermal fatigue lifetime, 2000 cycles or more are determined as "passing", and an examination on the thermal fatigue lifetime for a longer period of time is not made.

Most recently, Patent Document 7 discloses a technology in which a Nb carbonitride is used in addition to a Laves phase so as to maintain solid-solution strengthening of Nb and Mo, and an excellent thermal fatigue lifetime (1500 cycles or more) at 950° C. is obtained by an effect of minutely dispersing a Laves phase and an ε-Cu phase due to B.

PRIOR ART DOCUMENTS

Patent Documents

Patent Document 1: Japanese Unexamined Patent Application, First Publication No. 2008-189974

Patent Document 2: Japanese Unexamined Patent Application, First Publication No. 2009-120893

Patent Document 3: Japanese Unexamined Patent Application, First Publication No. 2009-120894

Patent Document 4: Japanese Unexamined Patent Application, First Publication No. 2009-197306

Patent Document 5: Japanese Unexamined Patent Application, First Publication No. 2009-197307

Patent Document 6: Japanese Unexamined Patent Application, First Publication No. 2012-207252

Patent Document 7: Japanese Unexamined Patent Application, First Publication No. 2011-190468

DISCLOSURE OF THE INVENTION

Problems to be Solved by the Invention

The present invention aims to provide a ferritic stainless steel having thermal fatigue properties more excellent than those of the related art particularly in an environment in which the highest temperature of an exhaust gas is approximately 1000° C., and the temperature of exhaust parts of an automobile is approximately 950° C. The object is to allow the thermal fatigue properties to be exhibited at a sufficiently high level and to be further stabilized when the ferritic stainless steel is used in a temperature range of approximately 950° C. for a long period of time.

Means for Solving the Problem

The prevent inventors have made a thorough investigation to solve the problems. As a result, they obtained the following findings. In Cu—Nb—Mo added steel, in the case where the Cu content is set to be more than 2.00% and the size of ε-Cu in a grain of a product is controlled such that the maximum particle size is 20 nm to 200 nm, the thermal fatigue properties at the highest temperature of 950° C. is improved to be better than those of SUS444, and the thermal fatigue lifetime becomes 2500 cycles or more which is longer than that found in the related art. In the related art, it is considered that the less ε-Cu precipitates in a product, the more preferable the results. However, in the case where the Cu content is more than 2.00%, when the steel is in the above-described precipitation state, the thermal fatigue properties are rarely different from thermal fatigue properties in a state in which ε-Cu is hardly precipitated in a product stage and ε-Cu is precipitated during a thermal fatigue test, and good workability can be secured.

FIG. 1 shows a result showing the relationship between the Cu content and the thermal fatigue lifetime at 950° C. with regard to steel containing 16.8% to 17.5% of Cr, 0.005% to 0.010% of C, 1.50% to 3.83% of Cu, 0.50% to 0.55% of Nb, 1.75% to 1.80% of Mo, 0.15% to 0.30% of Si, 0.15% to 0.25% of Mn, and 0.008% to 0.012% of N. It can be seen that in the case where the Cu content is more than 2.00%, the thermal fatigue lifetime becomes 2500 cycles or more. In addition, FIG. 2 shows a result showing the relationship between the maximum particle size of ε-Cu in a grain and the thermal fatigue lifetime at 950° C. which is obtained by using the same specimen as in FIG. 1. Here, the maximum particle size of ε-Cu in a grain is calculated as an equivalent circle diameter. The other measurement conditions are described in Examples.

It can be seen that in the case where the maximum particle size of ε-Cu that precipitates is 200 nm or less, the thermal fatigue lifetime at 950° C. is steadily in a range of 2500 cycles or more, and a stable lifetime is obtained. In the case where the Cu content is more than 2.00%, if the size of ε-Cu that precipitates is 200 nm or less, little difference is found in the thermal fatigue lifetime at 950° C. Although not clear, the reason is assumed to be as follows. During a thermal fatigue test repeated between a high temperature and a low temperature, when ε-Cu precipitates at a high temperature, coherent ε-Cu having a certain extent of a minute size is already dispersed, and thus precipitation and growth of coarse ε-Cu that newly precipitates are suppressed.

The features of an aspect of the invention for solving the above-described problem are as follows.

(1) A ferritic stainless steel sheet having excellent heat resistance, including, in terms of % by mass: C: 0.02% or less; N: 0.02% or less; Si: 0.10% to 0.60%; Mn: 0.10% to 0.80%; Cr: 15.0% to 21.0%; Cu: more than 2.00% to 3.50% or less; Nb: 0.30% to 0.80%; Mo: 1.00% to 2.50%; and B: 0.0003% to 0.0030%, with a remainder being Fe and unavoidable impurities, wherein a maximum particle size of ε-Cu that is present in a structure is 20 nm to 200 nm.

(2) The ferritic stainless steel sheet having excellent heat resistance according to (1), further including, in terms of % by mass: one or more selected from W: 2.0% or less, Mg: 0.0050% or less, Ni: 1.0% or less, Co: 1.0% or less, and Ta: 0.50% or less.

(3) The ferritic stainless steel sheet having excellent heat resistance according to (1) or (2), further including, in terms of % by mass: one or more selected from Al: 1.0% or less, V: 0.50% or less, Sn: 0.5% or less, Sb: 0.5% or less, Ga: 0.1% or less, Zr: 0.30% or less, and REM (rare-earth metal): 0.2% or less.

(4) A method of manufacturing the ferritic stainless steel sheet having excellent high-temperature strength according to any one of (1) to (3), the method including: a process of annealing a cold-rolled sheet, wherein a final annealing temperature of the cold-rolled sheet is 1000° C. to 1100° C., an average cooling rate in a temperature range from an end of a final annealing to 700° C. is 20° C./second or more, and an average cooling rate in a temperature range from 700° C. to 500° C. is 3° C./second to 20° C./second.

Here, with regard to an element in which the lower limit of an amount range thereof is not defined, the element is intended to be included at the level of unavoidable impurities.

Effects of the Invention

According to the aspect of the invention, thermal fatigue properties greater than those of SUS444 is obtained. That is, it is possible to provide ferritic stainless steel in which the thermal fatigue properties at 950° C. are greater than those of SUS444. Particularly, when the ferritic stainless steel according to the aspect of the invention is applied to an exhaust system member of an automobile or the like, it is possible to cope with a high-temperature situation in which an exhaust gas temperature is at or in the vicinity of 1000° C., and in which the temperature of an exhaust system part is at or in the vicinity of 950° C.

EMBODIMENTS FOR CARRYING OUT THE INVENTION

Figure 1:
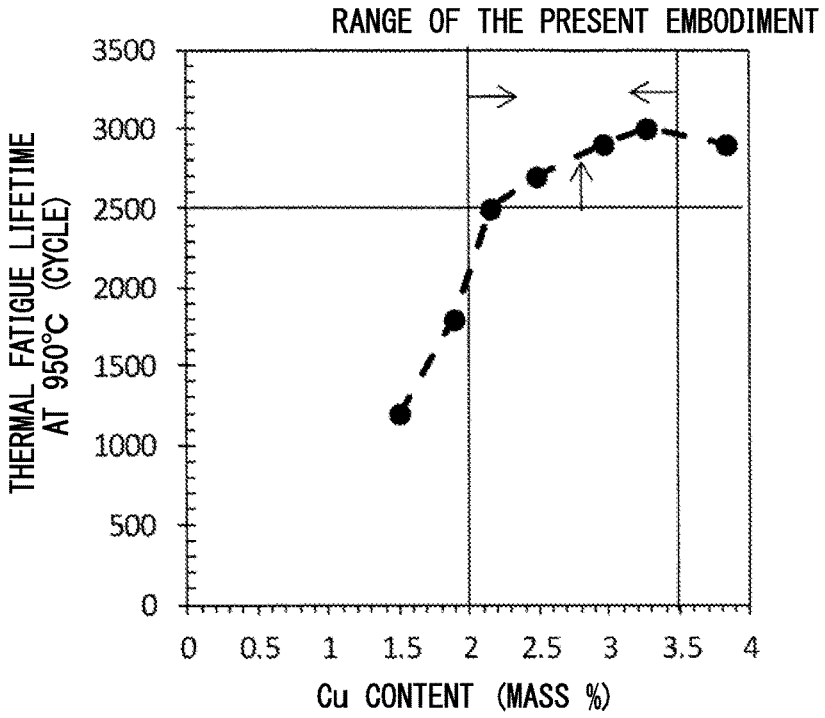
FIG. 1 is a graph showing the relationship between a Cu content and a thermal fatigue lifetime at 950° C.
Figure 2:
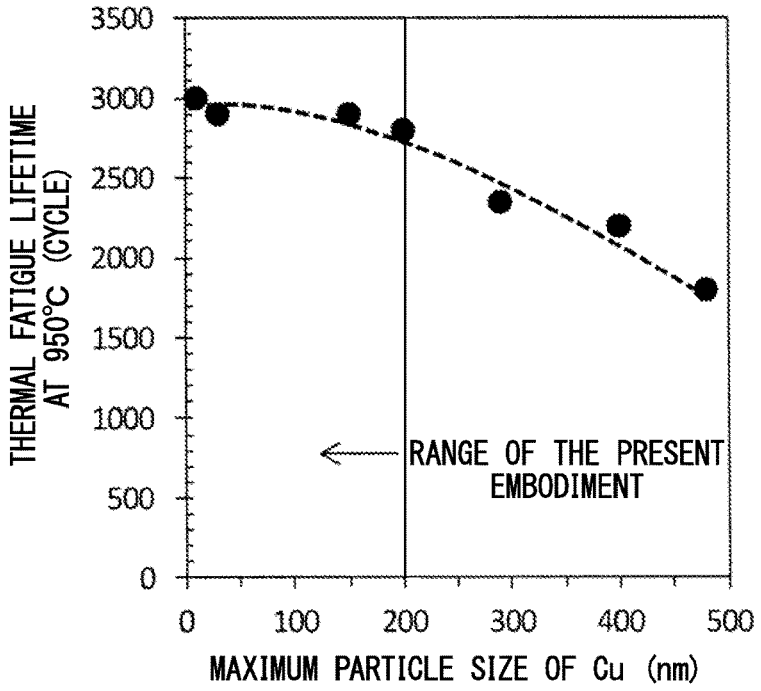
FIG. 2 is a graph showing the relationship between a precipitation size (maximum particle size) of ε-Cu, and a thermal fatigue lifetime at the highest temperature of 950° C.

Hereinafter, the invention will be described in detail. First, the reason for limitation in the invention will be described. The term "%" represents % by mass unless otherwise stated.

C deteriorates formability and corrosion resistance, and C promotes precipitation of a Nb carbonitride; and thereby, a decrease in high-temperature strength is caused. The lower the C content is, the more preferable the results. Accordingly, the C content is set to be 0.02% or less. However, an excessive reduction leads to an increase in refining costs, and thus the C content is preferably 0.003% to 0.015%.

As is the case with C, N deteriorates formability and corrosion resistance, and N promotes precipitation of Nb carbonitride; and thereby, a decrease in high-temperature strength is caused. The N content is preferably as low as possible. Accordingly, the N content is set to be 0.02% or less. However, an excessive reduction leads to an increase in the refining cost, and thus the N content is preferably 0.005% to 0.018%.

Si is a useful element as a deoxidizing agent, and Si is a very important element for improving oxidation resistance. The effect is exhibited at a content of 0.10% or more. However, in the case where the Si content is more than 0.60%, peeling-off of scales tends to occur. Accordingly, the Si content is set to be 0.10% to 0.60%. In addition, with regard to thermal fatigue properties, Si promotes precipitation of an intermetallic compound, which is called as a Laves phase and contains Fe, Nb, Mo, and W as a main component, at a high temperature. Accordingly, the Si content is preferably more than 0.10% to 0.30% or less.

Mn is an element that is added as a deoxidizing agent, Mn forms a Mn-based oxide in a surface layer portion during usage for a long period of time, and Mn contributes to the scale adhesiveness or the limitation of abnormal oxidation. The effect is exhibited at a content of 0.10% or more. On the other hand, excessive addition of Mn at a content of more than 0.80% decreases uniform elongation at room temperature. In addition, MnS is formed, and thus a decrease in the corrosion resistance or deterioration of oxidation resistance is caused. From these viewpoints, the upper limit of the Mn content is set to be 0.80%. In addition, the Mn content is preferably 0.10% to 0.60% from the viewpoint of high-temperature ductility or scale adhesiveness.

In this embodiment, Cr is an essential element for securing oxidation resistance. In the case where the Cr content is less than 15.0%, this effect is not exhibited, and in the case where the Cr content is more than 21.0%, the workability is decreased, or a deterioration in toughness is caused. Accordingly, the Cr content is set to be 15.0% to 21.0%. In addition, the Cr content is preferably 17.0% to 19.0% when high-temperature ductility and manufacturing cost are considered.

Cu is an element that is effective for improving thermal fatigue properties. This effect is caused by an operation of precipitation hardening due to precipitation of ε-Cu. In the case where more than 2.00% of Cu is added, the operation is greatly exhibited on thermal fatigue lifetime at approximately 950° C. On the other hand, in the case where an excessive amount of Cu is added, uniform elongation deteriorates, and yield strength at room temperature becomes too high, and thus a problem occurs in terms of press formability. In addition, in the case where more than 3.50% of Cu is added, an austenite phase is formed in a high temperature region, and thus abnormal oxidation tends to occur in a surface. Accordingly, the upper limit of the Cu content is set to 3.50%. In the case where the Cu content is more than 3.50%, there is a tendency that thermal fatigue properties are also saturated (thermal fatigue properties are not further improved). In addition, the Cu content is preferably 2.50% to 3.15% when manufacturability or scale adhesiveness is considered.

Nb is an element that is necessary for solid-solution strengthening and precipitation strengthening due to minute precipitation of a Laves phase. The thermal fatigue lifetime is improved by the solid-solution strengthening and the precipitation strengthening. In addition, Nb fixes C and N as carbonitrides, and Nb plays a role of contributing to the development of recrystallization texture which has an effect on corrosion resistance or an r value of a product sheet. In Nb—Mo—Cu added steel of this embodiment, the precipitation strengthening is obtained by including 0.30% or more of Nb. Accordingly, the lower limit of the Nb content is set to 0.30%. In addition, the addition of an excessive amount of Nb of more than 0.80% promotes coarsening of the Laves phase; and as a result, Nb does not affect the thermal fatigue lifetime, and cost also increases. Accordingly, the upper limit of the Nb content is set to 0.80%. In addition, the Nb content is preferably 0.40% to 0.65% when manufacturability and cost are considered.

Mo improves corrosion resistance, and Mo limits high-temperature oxidation. In addition, Mo is effective for precipitation strengthening due to minute precipitation of the Laves phase and solid-solution strengthening. The thermal fatigue properties are improved by the precipitation strengthening and the solid-solution strengthening. However, the addition of an excessive amount of Mo promotes coarse precipitation of a Laves phase, precipitation strengthening capability is deteriorated, and workability is deteriorated. In the invention, in the above-described Cu—Nb—Mo added steel, in the case where the Mo content is 1.00% or more, precipitation strengthening due to minute precipitation of the Laves phase and solid-solution strengthening are obtained. Accordingly, the lower limit of the Mo content is set to 1.00%. The addition of an excessive amount of Mo of more than 2.50% promotes coarsening of the Laves phase; and as a result, Mo does not affect the thermal fatigue lifetime, and cost also increases. Accordingly, the upper limit of the Mo content is set to 2.50%. In addition, the Mo content is preferably 1.50% to 2.10% when manufacturability and cost are considered. The Mo content is preferably 1.60% to 1.90% when oxidation resistance is considered.

B is an element that improves secondary workability during press processing of a product, and this effect is exhibited at a B content of 0.0003% or more. However, the addition of an excessive amount of B deteriorates hardening and grain boundary corrosion. Accordingly, the upper limit of the B content is set to 0.0030%. In addition, the B content is preferably 0.0003% to 0.0015% when formability or manufacturing cost is considered.

The existence form of ε-Cu in a crystal structure of a steel sheet will be explained. In the case where the Cu content is more than 2.00%, if the maximum particle size of ε-Cu in a product stage is 200 nm or less, it is possible to very effectively improve the thermal fatigue properties at 950° C. due to precipitation strengthening of an ε-Cu phase. However, in the case where the maximum particle size of ε-Cu is greater than 200 nm, growth of ε-Cu having a size of greater than 200 nm preferentially occurs rather than precipitation of new ε-Cu at a high temperature, and thus the precipitation strengthening does not effectively operate. Accordingly, the upper limit of the maximum particle size of ε-Cu is set to 200 nm. In addition, in the case where ε-Cu having a maximum particle size of less than 20 nm is allowed to precipitate, minute ε-Cu is densely dispersed, and thus the workability deteriorates. Accordingly, the lower limit of the maximum particle size of ε-Cu is set to 20 nm. In addition, in order to more effectively improve the thermal fatigue properties by the precipitation strengthening of ε-Cu, the maximum particle size of ε-Cu is preferably 30 nm to 100 nm. Here, in the case where the maximum particle size of ε-Cu is 20 nm to 200 nm, the precipitation density of ε-Cu having a particle size of 20 nm to 200 nm becomes in a range of 10 pieces/$\mu m^2$ or more. In the case where the maximum particle size of ε-Cu exceeds 200 nm or the maximum particle size is less than 20 nm, the precipitation density of ε-Cu having a particle size of 20 nm to 200 nm becomes less than 10 pieces/$\mu m^2$. This is also true in the case where the maximum particle size is 30 nm to 100 nm (a preferable particle size range of ε-Cu). That is, in the case where the maximum particle size of ε-Cu is 30 nm to 100 nm, the precipitation density of ε-Cu having a particle size of 30 nm to 100 nm becomes 10 pieces/$\mu m^2$ or more.

In addition, the following elements may be added so as to improve properties such as high-temperature strength.

W is an element which has the same effect as that of Mo, and W improves thermal fatigue properties. This effect is stably exhibited at a content of 0.05% or more. However, in the case where an excessive amount of W is added, coarsening of the Laves phase is promoted, coarsening of precipitates is caused, and manufacturability and workability deteriorate. Accordingly, the W content is preferably 2.00% or less. In addition, the W content is preferably 0.10% to 1.50% when cost, oxidation resistance, and the like are considered.

Mg is an element that improves secondary workability, and in the case where 0.0002% or more of Mg is added, the effect is stably exhibited. However, in the case where more than 0.0050% of Mg is added, workability greatly deteriorates, and thus the Mg content is preferably 0.0002% to 0.0050%. In addition, the Mg content is preferably 0.0002% to 0.0020% when cost or surface quality is considered.

Ni is an element that improves corrosion resistance. However, in the case where an excessive amount of Ni is added, an austenite phase is formed in a high temperature region, and thus abnormal oxidation and peeling-off of scales occur on a surface. Accordingly, the upper limit of the N content is set to 1.0%. In addition, this effect is exhibited at or above 0.05%, and the effect is stably exhibited from 0.1%, but the Ni content is preferably 0.1% to 0.6% when manufacturing cost is considered.

Co is an element that improves high-temperature strength. However, in the case where more than 1.0% of Co is added, manufacturability and workability greatly deteriorate. Accordingly, the Co content is set to be 1.0% or less. In addition, the Co content is preferably 0.05% to 0.50% when cost is considered.

Ta is an element that improves high-temperature strength, and Ta can be added as necessary. However, in the case where an excessive amount of Ta is added, a decrease in ductility at room temperature or a decrease in toughness is caused. Accordingly, the upper limit of the Ta content is set to 0.50%. The Ta content is preferably 0.05% to 0.30% to achieve a good balance between the high-temperature strength, the ductility, and toughness.

Al is a deoxidizing element, and is an element that improves oxidation resistance. Al is a strengthening element which is effective at improving strength. This operation is stably exhibited at an Al content of 0.10% or more. However, the addition of an excessive amount of Al greatly decreases uniform elongation due to hardening, and greatly decreases toughness. Accordingly, the upper limit of the Al content is set to 1.0%. In addition, the Al content is preferably 0.1% to 0.3% when occurrence of surface defects, weldability, and manufacturability are considered. On the other hand, in the case of adding Al for deoxidation, less than 0.10% of Al remains in steel as an unavoidable impurity.

V forms a minute carbonitride in combination with Nb, and V contributes an improvement of a thermal fatigue lifetime due to the occurrence of an operation of precipitation strengthening. This effect is stably exhibited in the case where 0.05% or more of V is added. However, in the case where more than 0.50% of V is added, a Nb carbonitride is coarsened; and thereby, high-temperature strength decreases, and the thermal fatigue lifetime and workability tend to decrease. Accordingly, the upper limit of the V content is set to 0.50%. In addition, the V content is preferably 0.05% to 0.30% when manufacturing cost or manufacturability is considered.

Sn is an element that improves a thermal fatigue lifetime due to solid-solution strengthening, and this effect is stably exhibited at an addition of 0.05% or more of Sn. In addition, Sn is also an element that improves corrosion resistance, and this effect is exhibited in the case where 0.01% or more of Sn is added. However, in the case where more than 0.50% of Sn is added, the workability greatly deteriorates. Accordingly, the Sn content is set to be 0.50% or less. In addition, the Sn content is preferably 0.05% to 0.30% when cost or surface quality is considered.

Sb is effective for improving corrosion resistance, and 0.5% or less of Sb may be added as necessary. Particularly, the lower limit of the Sb content is preferably 0.005% from the viewpoint of crevice corrosion. In addition, the lower limit of the Sb content is preferably 0.01% from the viewpoint of manufacturability or cost. The upper limit of the Sb content is preferably 0.1% from the viewpoint of cost.

0.1% or less of Ga may be added to improve corrosion resistance or to limit hydrogen embrittlement. The lower limit of the Ga content is preferably 0.0005% from the viewpoint of formation of a sulfide or a hydride. The Ga content is preferably 0.0010% or more and more preferably 0.0020% or more from the viewpoint of manufacturability or cost.

As is the case with Nb, Ti, and the like, Zr forms a carbonitride, Zr limits formation of Cr carbonitride, and Zr improves corrosion resistance. Accordingly, it is preferable to add 0.01% or more of Zr as necessary. In addition, even in the case where more than 0.30% of Zr is added, the effect becomes saturated (the effect is not further improved), and this addition becomes a cause of surface defects due to formation of a large oxide. Accordingly, the Zr content is preferably 0.01% to 0.30%, and more preferably 0.20% or less. Zr is an element that is more expensive than Ti and Nb, and thus it is preferable that the Zr content be set to be 0.02% to 0.05% when manufacturing cost is considered.

A REM (rare-earth metal) is an element that exhibits an effect of improving oxidation resistance or adhesiveness of an oxide film. The lower limit of the REM content (the total content of the rare-earth metal elements) is preferably 0.002% so as to exhibit the effect. The effect becomes saturated (the effect is not further improved) at a REM content of 0.2%. Here, the REM (rare-earth element) follows a general definition, and represents a collective term for two elements of scandium (Sc) and yttrium (Y), and 15 elements (lanthanoids) from lanthanum (La) to lutetium (Lu). Among these REM elements, one may be added alone, or a mixture of two or more may be added.

With regard to other components, there is no particular limitation in this embodiment. However, in this embodiment, 0.001% to 0.1% of Hf, Bi, and the like may be added as necessary. On the other hand, it is preferable that the amount of generally harmful elements such as As, Pb, and the like, or impurities be reduced as much as possible.

With regard to a method for manufacturing a steel sheet, up to a heating process in finish annealing, it is possible to employ processes in a method for manufacturing general ferritic stainless steel. For example, ferritic stainless steel having a composition in the range of this embodiment is melted to prepare a slab. The slab is heated at a temperature of 1000° C. to 1300° C., and the slab is subjected to hot rolling in a temperature range of 1100° C. to 700° C. to prepare a hot-rolled sheet having a thickness of 4 mm to 6 mm. Then, annealing is performed at a temperature of 800° C. to 1100° C., and pickling is performed to obtain an annealed and pickled sheet. The annealed and pickled sheet is subjected to cold rolling to prepare a cold-rolled sheet having a thickness of 1.0 mm to 2.5 mm. Then, finish annealing is performed at a temperature of 1000° C. to 1100° C., and then pickling is performed. It is possible to manufacture a steel sheet through these processes. However, with regard to a cooling rate after the finish annealing, in the case where the cooling rate in a temperature range up to 700° C. is low, ε-Cu is coarsened, and precipitates such as a Laves phase and the like greatly precipitate. In this case, there is a possibility that thermal fatigue properties may not be exhibited, and workability such as ductility at room temperature and the like may deteriorate. Accordingly, it is preferable that the average cooling rate in the temperature range from the final annealing temperature to 700° C. be controlled to be 20° C./second or more. In the case where the average cooling rate is controlled to be 20° C./second to 100° C./second, the object is accomplished. In the case where the average cooling rate is controlled to be 20° C./second to 30° C./second, the effect obtained due to the control of the cooling rate is sufficiently exhibited. In addition, the average cooling rate is preferably 30° C./second or more, and more preferably 50° C./second or more when an improvement of manufacturability is considered. In addition, in a temperature range of 700° C. to 500° C. in which precipitation of Cu occurs most greatly, if excessive cooling is performed, a minute ε-Cu phase having a size of less than 20 nm precipitates densely, and thus workability at room temperature deteriorates. In addition, if excessive cooling is performed in order for ε-Cu not to precipitate, the sheet thickness shape deteriorates. Accordingly, it is preferable to control the cooling rate to be in a constant range. In this embodiment, it is necessary to allow ε-Cu having the maximum particle size of 20 nm or greater to precipitate, and thus excessive cooling is not preferable, and it is preferable to perform cooling at a cooling rate of 20° C./second or less. However, in the case where the cooling rate is too low, ε-Cu is coarsened, and thus the effect of improving thermal fatigue properties is not effectively exhibited. Accordingly, the lower limit of the cooling rate is set to 3° C./second. In addition, the cooling rate is preferably 5° C./second to 15° C./second when manufacturability is considered. In addition, hot-rolling conditions of the hot-rolled sheet, the thickness of the hot-rolled sheet, whether the hot-rolled sheet is subjected to annealing or not, cold-rolling conditions, and an annealing temperature, atmosphere, and the like of the hot-rolled sheet and the cold-rolled sheet can be appropriately selected. In addition, cold-rolling and annealing may be repeated a plurality of times, or temper-rolling or a tension leveler may be applied after the cold-rolling and annealing. In addition, the sheet thickness of a product may be selected in accordance with the thickness of a member which is demanded.

EXAMPLES

<Method of Producing Samples>

Steel having a component composition shown in Table 1 and Table 2 was melted to cast 50 kg of a slab. The slab was subjected to hot rolling at a temperature of 1100° C. to 700° C. to obtain a hot-rolled sheet having a thickness of 5 mm. Then, the hot-rolled sheet was annealed at a temperature of 900° C. to 1000° C., and the hot-rolled sheet was subsequently subjected to pickling. Cold-rolling was performed to obtain a thickness of 2 mm, and annealing and pickling were performed to obtain a product sheet. The annealing temperature of the cold-rolled sheet was set to be 1000° C. to 1100° C. Nos. A1 to A23 in Table 1 represent Invention Examples, and Nos. 18 to 39 in Table 2 represent Comparative Examples. In Table 1 and Table 2, an underlined value represents a value outside of the range of this embodiment, and "–" represents no addition.

<Method Measuring ε-Cu>

As a sample of the cold-rolled and annealed sheet, a thin film sample was collected by an electrolytic polishing method, and a structure was observed with a transmission electron microscope (FE-TEM). An arbitrary portion was observed at a 20000-fold magnification, and 10 photographs of which precipitated into a grain were taken. At this magnification, it was possible to observe a distribution state of ε-Cu in an approximately uniform manner. The photographs were scanned by a scanner, and only ε-Cu was subjected to color image processing. Subsequently, an area of each particle was measured by using an image analysis software "Scion Image" manufactured by Scion Corporation. An equivalent circle diameter was calculated from the area of the particle, and a particle size of ε-Cu was measured. Fe, Cu, Nb, Mo, and Cr were quantified with an EDS apparatus (energy dispersive fluorescent X-ray analyzer) equipped with an FE-TEM to classify the kind of precipitates. ε-Cu is approximately pure Cu, and thus a precipitate, in which the Cu content was greater than an added amount of Cu was referred to as ε-Cu. Evaluation of ε-Cu was performed in two ways including evaluation of the maximum particle size and evaluation of a precipitation density. With regard to the evaluation of the maximum particle size, a steel sheet in which the maximum particle size of ε-Cu was 20 nm to 200 nm was evaluated as "good", and the evaluation result was listed as "B" in the tables. In the steel sheet, a steel sheet in which the maximum particle size of ε-Cu was 30 nm to 100 nm was evaluated as "excellent", and the evaluation result was listed as "A" in the tables. A steel sheet in which the maximum particle size of ε-Cu was in a range of less than 20 nm or in a range of more than 200 nm was evaluated as "bad", and the evaluation result was listed as "C" in the tables. With regard to the evaluation of the precipitation density, a steel sheet in which the precipitation density of ε-Cu having a size of 20 nm to 200 nm was 10 pieces/$\mu m^2$ or more was evaluated as "good", and the evaluation result was listed as "B" in the tables. In addition, a steel sheet in which the precipitation density of ε-Cu having a size of 30 nm to 100 nm was 10 pieces/$\mu m^2$ or more was evaluated as "excellent", and the evaluation result was listed as "A" in the tables. A steel sheet in which the precipitation density of ε-Cu having a size of 20 nm to 200 nm was less than 10 pieces/$\mu m^2$ was evaluated as "bad", and the evaluation result was listed as "C" in the tables.

<Thermal Fatigue Test Method>

The product sheet that was obtained as described above was coiled in a pipe shape, and ends of the sheet were welded through TIG welding to prepare a pipe having a diameter of 30 mmϕ. In addition, this pipe was cut in a length of 300 mm to prepare a thermal fatigue specimen having a grade distance of 20 mm. The following heat treatment cycle was repeated with respect to the specimen at a restriction rate of 20% in the air by using a servo-pulser type thermal fatigue tester (heating was performed with a high-frequency induction heating device), and the thermal fatigue lifetime was evaluated.

Heat treatment cycle (1 cycle): the temperature was raised from 200° C. to 950° C. for 150 seconds. Subsequently, the specimen was held at 950° C. for 120 seconds. Subsequently, the temperature was lowered from 950° C. to 200° C. for 150 seconds. Here, the number of cycles when a crack penetrated through a sheet thickness was defined as the thermal fatigue lifetime. The penetration was confirmed by visual examination whenever 100 cycles had elapsed. A steel sheet in which the thermal fatigue lifetime was 2500 cycles or more was evaluated as "good", and the evaluation result was listed as "B" in the tables. A steel sheet in which the thermal fatigue lifetime was 2800 cycles or more was evaluated as "excellent", and the evaluation result was listed as "A" in the tables. A steel sheet in which the thermal fatigue lifetime was less than 2500 cycles was evaluated as "bad", and the evaluation result was listed as in the tables.

<Method of Evaluating Workability at Room Temperature>

A specimen of No. JIS13B in which a rolling direction was set to a longitudinal direction was prepared. In addition, a tensile test was performed to measure breaking elongation (total elongation). Here, in the case where the breaking elongation at room temperature is 26% or greater, it is possible to process a steel sheet into a typical exhaust part. Accordingly, a steel sheet having a breaking elongation of 26% or greater was evaluated as "good" and the evaluation result was listed as "B" in the tables. A steel sheet having a breaking elongation of less than 26% was evaluated as "bad" and the evaluation result was listed as "C" in the tables.

The obtained evaluation results are shown in Table 3 and Table 4.

TABLE 1

| | No. | Contents of components (% by mass) | | | | | | | | | |
|---|---|---|---|---|---|---|---|---|---|---|---|
| | | C | N | Si | Mn | Cr | Cu | Nb | Mo | B | Others |
| Invention Examples | A1 | 0.011 | 0.016 | 0.28 | 0.29 | 18.1 | 2.57 | 0.77 | 2.39 | 0.0005 | — |
| | A2 | 0.005 | 0.011 | 0.56 | 0.35 | 17.6 | 2.85 | 0.45 | 1.70 | 0.0008 | — |
| | A3 | 0.005 | 0.012 | 0.24 | 0.75 | 17.8 | 3.01 | 0.44 | 1.71 | 0.0009 | — |
| | A4 | 0.007 | 0.010 | 0.20 | 0.13 | 20.6 | 2.69 | 0.53 | 1.85 | 0.0008 | — |
| | A5 | 0.006 | 0.010 | 0.15 | 0.38 | 18.7 | 3.05 | 0.56 | 1.68 | 0.0021 | — |
| | A6 | 0.007 | 0.009 | 0.29 | 0.33 | 18.4 | 2.72 | 0.47 | 1.65 | 0.0014 | W: 0.06 |
| | A7 | 0.005 | 0.010 | 0.12 | 0.56 | 18.3 | 2.38 | 0.60 | 1.90 | 0.0010 | W: 1.37 |
| | A8 | 0.008 | 0.013 | 0.30 | 0.52 | 19.0 | 2.81 | 0.38 | 1.55 | 0.0007 | W: 0.45 |
| | A9 | 0.006 | 0.010 | 0.18 | 0.48 | 18.5 | 3.17 | 0.50 | 1.89 | 0.0006 | — |
| | A10 | 0.005 | 0.011 | 0.29 | 0.58 | 18.5 | 2.87 | 0.45 | 2.07 | 0.0006 | — |
| | A11 | 0.008 | 0.013 | 0.14 | 0.46 | 17.5 | 2.95 | 0.57 | 1.85 | 0.0011 | — |
| | A12 | 0.005 | 0.011 | 0.15 | 0.42 | 17.2 | 2.81 | 0.51 | 1.28 | 0.0007 | W: 1.62 |
| | A13 | 0.005 | 0.011 | 0.33 | 0.58 | 18.0 | 2.80 | 0.55 | 2.02 | 0.0011 | Mg: 0.0005 |
| | A14 | 0.008 | 0.012 | 0.30 | 0.40 | 17.5 | 3.10 | 0.40 | 1.99 | 0.0006 | Ni: 0.3 |
| | A15 | 0.006 | 0.012 | 0.21 | 0.30 | 17.8 | 2.91 | 0.43 | 1.83 | 0.0007 | Co: 0.33 |
| | A16 | 0.008 | 0.015 | 0.23 | 0.24 | 18.1 | 2.92 | 0.48 | 1.75 | 0.0010 | Ta: 0.25 |
| | A17 | 0.006 | 0.011 | 0.22 | 0.52 | 17.4 | 2.88 | 0.45 | 1.78 | 0.0005 | Al: 0.41 |
| | A18 | 0.005 | 0.011 | 0.16 | 0.34 | 19.0 | 3.20 | 0.32 | 1.17 | 0.0005 | V: 0.18 |
| | A19 | 0.006 | 0.010 | 0.15 | 0.36 | 15.7 | 2.93 | 0.52 | 1.85 | 0.0009 | Sn: 0.10 |
| | A20 | 0.007 | 0.010 | 0.25 | 0.37 | 18.5 | 3.18 | 0.52 | 1.95 | 0.0005 | Sb: 0.05 |
| | A21 | 0.007 | 0.015 | 0.35 | 0.58 | 18.4 | 3.07 | 0.51 | 1.93 | 0.0007 | Ga: 0.004 |
| | A22 | 0.006 | 0.012 | 0.30 | 0.63 | 18.6 | 2.92 | 0.42 | 2.01 | 0.0006 | Zr: 0.04 |
| | A23 | 0.006 | 0.012 | 0.29 | 0.48 | 19.1 | 2.95 | 0.56 | 1.87 | 0.0005 | REM: 0.01 |

TABLE 2

| | No. | Contents of components (% by mass) | | | | | | | | | |
|---|---|---|---|---|---|---|---|---|---|---|---|
| | | C | N | Si | Mn | Cr | Cu | Nb | Mo | B | Others |
| Comparative Examples | 18 | 0.030 | 0.012 | 0.28 | 0.51 | 18.9 | 3.15 | 0.41 | 1.55 | 0.0005 | — |
| | 19 | 0.005 | 0.035 | 0.20 | 0.42 | 17.5 | 2.77 | 0.50 | 1.91 | 0.0007 | — |
| | 20 | 0.005 | 0.013 | 0.89 | 0.29 | 18.6 | 2.65 | 0.45 | 1.67 | 0.0006 | — |
| | 21 | 0.006 | 0.009 | 0.28 | 1.25 | 18.0 | 2.88 | 0.48 | 1.70 | 0.0008 | W: 0.70 |
| | 22 | 0.006 | 0.011 | 0.19 | 0.55 | 23.8 | 3.01 | 0.60 | 1.95 | 0.0008 | — |
| | 23 | 0.006 | 0.011 | 0.20 | 0.28 | 16.8 | 1.89 | 0.52 | 1.78 | 0.0010 | — |
| | 24 | 0.006 | 0.012 | 0.21 | 0.25 | 19.2 | 3.83 | 0.44 | 2.01 | 0.0010 | — |
| | 25 | 0.007 | 0.010 | 0.25 | 0.22 | 18.7 | 2.91 | 0.20 | 1.83 | 0.0005 | — |
| | 26 | 0.005 | 0.011 | 0.23 | 0.58 | 18.0 | 2.76 | 1.14 | 1.72 | 0.0005 | — |
| | 27 | 0.005 | 0.009 | 0.30 | 0.39 | 18.6 | 2.75 | 0.51 | 0.91 | 0.0006 | W: 0.12 |
| | 28 | 0.005 | 0.012 | 0.28 | 0.21 | 18.0 | 2.88 | 0.51 | 3.01 | 0.0006 | — |
| | 29 | 0.005 | 0.010 | 0.15 | 0.56 | 17.2 | 2.58 | 0.47 | 1.91 | 0.0005 | W: 2.55 |
| | 30 | 0.006 | 0.013 | 0.25 | 0.45 | 19.0 | 3.10 | 0.45 | 1.68 | 0.0055 | — |
| | 31 | 0.005 | 0.012 | 0.18 | 0.51 | 16.4 | 3.08 | 0.44 | 1.87 | 0.0006 | Mg: 0.0078 |
| | 32 | 0.007 | 0.012 | 0.25 | 0.55 | 17.4 | 2.88 | 0.42 | 1.65 | 0.0005 | Ni: 1.5 |
| | 33 | 0.007 | 0.010 | 0.30 | 0.32 | 18.0 | 2.87 | 0.47 | 1.87 | 0.0006 | Co: 1.8 |
| | 34 | 0.007 | 0.009 | 0.21 | 0.57 | 18.1 | 2.65 | 0.41 | 1.67 | 0.0005 | Al: 2.10 |
| | 35 | 0.006 | 0.009 | 0.18 | 0.58 | 18.6 | 2.67 | 0.62 | 1.83 | 0.0005 | V: 0.86 |
| | 36 | 0.006 | 0.010 | 0.16 | 0.48 | 18.4 | 2.73 | 0.58 | 2.00 | 0.0008 | Sn: 0.76 |
| | 37 | 0.005 | 0.011 | 0.23 | 0.58 | 18.5 | 2.81 | 0.45 | 1.97 | 0.0008 | — |
| | 38 | 0.006 | 0.012 | 0.19 | 0.58 | 18.6 | 2.82 | 0.45 | 1.98 | 0.0008 | — |
| | 39 | 0.005 | 0.012 | 0.27 | 0.57 | 18.6 | 2.82 | 0.44 | 1.98 | 0.0008 | — |

TABLE 3

| | No. | Precipitation state of ε-Cu | | Cooling rate from finish annealing to 700° C. (° C./second) | Cooling rate from 700° C. to 500° C. (° C./second) | Thermal fatigue lifetime at 950° C. | Breaking elongation at room temperature |
|---|---|---|---|---|---|---|---|
| | | Maximum particle size | Precipitation density of 20 to 200 nm | | | | |
| Invention Examples | A1 | B | B | 25.0 | 3.0 | B | B |
| | A2 | B | B | 30.0 | 17.0 | B | B |
| | A3 | B | B | 20.0 | 15.0 | B | B |
| | A4 | B | B | 20.0 | 13.0 | B | B |
| | A5 | B | B | 25.0 | 10.0 | B | B |
| | A6 | A | A | 30.0 | 10.0 | A | B |
| | A7 | B | B | 100.0 | 7.0 | B | B |
| | A8 | B | B | 20.0 | 10.0 | B | B |

TABLE 3-continued

| No. | Precipitation state of ε-Cu: Maximum particle size | Precipitation state of ε-Cu: Precipitation density of 20 to 200 nm | Cooling rate from finish annealing to 700° C. (° C./second) | Cooling rate from 700° C. to 500° C. (° C./second) | Thermal fatigue lifetime at 950° C. | Breaking elongation at room temperature |
|---|---|---|---|---|---|---|
| A9 | B | B | 25.0 | 5.0 | B | B |
| A10 | A | A | 20.0 | 15.0 | A | B |
| A11 | A | A | 20.0 | 3.0 | A | B |
| A12 | B | B | 20.0 | 8.0 | B | B |
| A13 | B | B | 30.0 | 7.0 | B | B |
| A14 | A | A | 20.0 | 5.0 | A | B |
| A15 | B | B | 25.0 | 18.0 | B | B |
| A16 | A | A | 30.0 | 8.0 | A | B |
| A17 | B | B | 20.0 | 10.0 | B | B |
| A18 | B | B | 20.0 | 10.0 | B | B |
| A19 | B | B | 30.0 | 7.0 | A | B |
| A20 | B | B | 25.0 | 5.0 | A | B |
| A21 | B | B | 30.0 | 10.0 | B | B |
| A22 | B | B | 30.0 | 10.0 | B | B |
| A23 | B | B | 25.0 | 10.0 | B | B |

TABLE 4

| | No. | Precipitation state of ε-Cu: Maximum particle size | Precipitation state of ε-Cu: Precipitation density of 20 to 200 nm | Cooling rate from finish annealing temperature to 700° C. (° C./second) | Cooling rate from 700° C. to 500° C. (° C./second) | Thermal fatigue lifetime at 950° C. | Breaking elongation at room temperature |
|---|---|---|---|---|---|---|---|
| Comparative Examples | 18 | B | B | 20.0 | 17.0 | C | B |
| | 19 | B | B | 20.0 | 10.0 | C | B |
| | 20 | B | B | 20.0 | 15.0 | C | C |
| | 21 | B | B | 25.0 | 10.0 | B | C |
| | 22 | B | B | 30.0 | 8.0 | B | C |
| | 23 | B | B | 20.0 | 8.0 | C | B |
| | 24 | B | B | 30.0 | 8.0 | B | C |
| | 25 | B | B | 30.0 | 7.0 | C | B |
| | 26 | B | B | 20.0 | 10.0 | B | C |
| | 27 | B | B | 50.0 | 5.0 | C | B |
| | 28 | B | B | 25.0 | 5.0 | B | C |
| | 29 | B | B | 30.0 | 15.0 | B | C |
| | 30 | B | B | 35.0 | 5.0 | B | C |
| | 31 | B | B | 23.0 | 4.0 | B | C |
| | 32 | B | B | 25.0 | 5.0 | B | C |
| | 33 | B | B | 20.0 | 10.0 | B | C |
| | 34 | B | B | 20.0 | 8.0 | B | C |
| | 35 | B | B | 25.0 | 15.0 | B | C |
| | 36 | B | B | 20.0 | 17.0 | B | C |
| | 37 | C | C | 10.0 | 10.0 | C | C |
| | 38 | C | C | 25.0 | 25.0 | B | C |
| | 39 | C | C | 20.0 | 2.0 | C | B |

<Evaluation Result>

As is clear from Table 3 and Table 4, Invention Examples have a component composition which is defined in this embodiment, and the maximum particle size of ε-Cu is in a range of this embodiment. From this result, it can be seen that the thermal fatigue lifetime at 950° C. in Invention Examples is more excellent than that in Comparative Examples.

Particularly, in Steel Nos. A6, A10, A11, A14, and A16 which satisfy all the preferred conditions, the thermal fatigue lifetime is further good. In addition, with regard to mechanical properties at room temperature, fracture ductility is good, and thus it can be seen that workability equal to or greater than that in Comparative Examples is provided.

In Steel No. 18, the C content exceeds the upper limit of this embodiment. In Steel No. 19, the N content exceeds the upper limit of this embodiment. Accordingly, in Steel Nos. 18 and 19, the thermal fatigue lifetime at 950° C. is lower than that in Invention Examples.

In Steel No. 20, the Si content exceeds the upper limit of this embodiment. Accordingly, the thermal fatigue lifetime is lower than those in Invention Examples.

In Steel No. 21, Mn is excessively added. In Steel No. 22, Cr is excessively added. Accordingly, in Steel Nos. 21 and 22, the ductility at room temperature is low.

In Steel No. 23, the Cu content is less than the lower limit of this embodiment. In Steel No. 25, the Nb content is less than the lower limit of this embodiment. In Steel No. 27, the Mo content is less than the lower limit of this embodiment. Accordingly, in Steel Nos. 23, 25, and 27, the thermal fatigue lifetime is poor.

In Steel No. 24, the Cu content exceeds the upper limit of this embodiment. In Steel No. 26, the Nb content exceeds the upper limit of this embodiment. In Steel No. 28, the Mo content exceeds the upper limit of this embodiment. In Steel No. 29, the W content exceeds the upper limit of this embodiment. Accordingly, in Steel Nos. 24, 26, 28, and 29, the thermal fatigue lifetime is excellent, but the ductility at room temperature is low.

In Steel No. 30, the B content exceeds the upper limit of this embodiment. In Steel No. 31, the Mg content exceeds the upper limit of this embodiment. In Steel No. 32, the Ni content exceeds the upper limit of this embodiment. In Steel No. 33, the Co content exceeds the upper limit of this embodiment. In Steel No. 34, the Al content exceeds the upper limit of this embodiment. In Steel No. 35, the V content exceeds the upper limit of this embodiment. In Steel No. 36, the Sn content exceeds the upper limit of this embodiment. In Steel Nos. 30 to 36, the thermal fatigue lifetime is excellent, but the ductility at room temperature is low.

In Steel No. 37, the component composition is in the range of this embodiment, but the cooling rate from the finish annealing temperature to 700° C. is low. Accordingly, the maximum particle size of ε-Cu exceeds 200 nm, and the thermal fatigue lifetime and the ductility at room temperature are low.

In Steel No. 38, the component composition is in the range of this embodiment, but the cooling rate from 700° C. to 500° C. is too high. Accordingly, very minute ε-Cu precipitates, and thus the maximum particle size of s-Cu becomes less than 20 nm. Accordingly, the thermal fatigue lifetime is excellent, but the ductility at room temperature is poor.

In steel No. 39, the component composition is in the range of this embodiment, but the cooling rate from 700° C. to 500° C. is too low. Accordingly, very coarse ε-Cu precipitates, and thus the maximum particle size of ε-Cu exceeds 200 nm. Accordingly, the thermal fatigue lifetime is poor.

On the other hand, in the case where the maximum particle size of ε-Cu is 20 nm to 200 nm, it can be seen that the precipitation density of ε-Cu having a particle size of 20 nm to 200 nm is 10 pieces/$\mu m^2$ or more. In addition, in the case where the maximum particle size of ε-Cu is in a range of more than 200 nm or in a range of less than 20 nm, it can be seen that the precipitation density of ε-Cu having a particle size of 20 nm to 200 nm is less than 10 pieces/$\mu m^2$.

INDUSTRIAL APPLICABILITY

The ferritic stainless steel of this embodiment is excellent in heat resistance, and thus the ferritic stainless steel can be used as an exhaust gas path member of a power generation plant in addition to an exhaust system member of an automobile. In addition, the ferritic stainless steel of this embodiment contains Mo that is effective for improving corrosion resistance, and thus the ferritic stainless steel can be used for a use in which the corrosion resistance is necessary.

The invention claimed is:

1. A ferritic stainless steel sheet having excellent heat resistance, consisting of, in terms of % by mass:

C: 0.02% or less;
N: 0.02% or less;
Si: 0.10% to 0.60%;
Mn: 0.10% to 0.80%;
Cr: 15.0% to 19.0%;
Cu: 2.80% to 3.50%;
Nb: 0.30% to 0.80%;
Mo: 1.00% to 2.50%;
B: 0.0003% to 0.0030%; and
a remainder of Fe and unavoidable impurities,
wherein a maximum particle size of ε-Cu that is present in a structure is 30 nm to 200 nm.

2. A method of manufacturing the ferritic stainless steel sheet having excellent heat resistance according to claim 1, the method comprising:

a process of annealing a cold-rolled sheet,
wherein a final annealing temperature of the cold-rolled sheet is 1000° C. to 1100° C.,
an average cooling rate in a temperature range from an end of a final annealing to 700° C. is 20° C./second or more, and
an average cooling rate in a temperature range from 700° C. to 500° C. is 3° C./second to 20° C./second.

3. A ferritic stainless steel sheet having excellent heat resistance consisting of, in terms of % by mass:

C: 0.02% or less;
N: 0.02% or less;
Si: 0.10% to 0.60%;
Mn: 0.10% to 0.80%;
Cr: 15.0% to 19.0%;
Cu: 2.80% to 3.50%;
Nb: 0.30% to 0.80%;
Mo: 1.00% to 2.50%;
B: 0.0003% to 0.0030%;
one or more selected from W: 2.0% or less, Mg: 0.0050% or less, Ni: 1.0% or less, Co: 1.0% or less, and Ta: 0.50% or less; and
a remainder of Fe and unavoidable impurities,
wherein a maximum particle size of ε-Cu that is present in a structure is 30 nm to 200 nm.

4. A method of manufacturing the ferritic stainless steel sheet having excellent heat resistance according to claim 3, the method comprising:

a process of annealing a cold-rolled sheet,
wherein a final annealing temperature of the cold-rolled sheet is 1000° C. to 1100° C.,
an average cooling rate in a temperature range from an end of a final annealing to 700° C. is 20° C./second or more, and
an average cooling rate in a temperature range from 700° C. to 500° C. is 3° C./second to 20° C./second.

5. A ferritic stainless steel sheet having excellent heat resistance consisting of, in terms of % by mass:

C: 0.02% or less;
N: 0.02% or less;
Si: 0.10% to 0.60%;
Mn: 0.10% to 0.80%;
Cr: 15.0% to 19.0%;
Cu: 2.80% to 3.50%;
Nb: 0.30% to 0.80%;
Mo: 1.00% to 2.50%;
B: 0.0003% to 0.0030%;
one or more selected from Al: 1.0% or less, V: 0.50% or less, Sn: 0.5% or less, Sb: 0.5% or less, Ga: 0.1% or less, Zr: 0.30% or less, and REM (rare-earth metal): 0.2% or less; and
a remainder of Fe and unavoidable impurities,
wherein a maximum particle size of ε-Cu that is present in a structure is 30 nm to 200 nm.

6. A method of manufacturing the ferritic stainless steel sheet having excellent heat resistance according to claim 5, the method comprising:

a process of annealing a cold-rolled sheet,
wherein a final annealing temperature of the cold-rolled sheet is 1000° C. to 1100° C.,
an average cooling rate in a temperature range from an end of a final annealing to 700° C. is 20° C./second or more, and an average cooling rate in a temperature range from 700° C. to 500° C. is 3° C./second to 20° C./second.

7. A ferritic stainless steel sheet having excellent heat resistance consisting of, in terms of % by mass:

C: 0.02% or less;

N: 0.02% or less;

Si: 0.10% to 0.60%;

Mn: 0.10% to 0.80%;

Cr: 15.0% to 19.0%;

Cu: 2.80% to 3.50%;

Nb: 0.30% to 0.80%;

Mo: 1.00% to 2.50%;

B: 0.0003% to 0.0030%;

one or more selected from W: 2.0% or less, Mg: 0.0050% or less, Ni: 1.0% or less, Co: 1.0% or less, and Ta: 0.50% or less;

one or more selected from Al: 1.0% or less, V: 0.50% or less, Sn: 0.5% or less, Sb: 0.5% or less, Ga: 0.1% or less, Zr: 0.30% or less, and REM (rare-earth metal): 0.2% or less; and a remainder of Fe and unavoidable impurities, wherein a maximum particle size of E-Cu that is present in a structure is 30 nm to 200 nm.

8. A method of manufacturing the ferritic stainless steel sheet having excellent heat resistance according to claim 7, the method comprising:

a process of annealing a cold-rolled sheet, wherein a final annealing temperature of the cold-rolled sheet is 1000° C. to 1100° C., an average cooling rate in a temperature range from an end of a final annealing to 700° C. is 20° C./second or more, and an average cooling rate in a temperature range from 700° C. to 500° C. is 3° C./second to 20° C./second.

* * * * *